US005927107A

United States Patent [19]

Mitchell

[11] Patent Number: 5,927,107

[45] Date of Patent: Jul. 27, 1999

[54] METHOD AND APPARATUS FOR LOCKING A STORAGE CONTAINER

[75] Inventor: David Mitchell, Wildwood, Mo.

[73] Assignee: Loc-R-Bar, L.L.C., St. Louis, Mo.

[21] Appl. No.: 08/790,053

[22] Filed: Jan. 28, 1997

[51] Int. Cl.[6] ..... E05B 73/00

[52] U.S. Cl. ..... 70/14; 70/58; 70/94; 292/259

[58] Field of Search ..... 70/94, 101, 14, 70/57, 58, 158–173, 209; 292/288, 289, 338, 339, 259 R

[56] References Cited

U.S. PATENT DOCUMENTS

| | | | |
|---|---|---|---|
| 3,280,606 | 10/1966 | Howard et al. | 292/259 |
| 3,656,788 | 4/1972 | Emery | 292/259 R X |
| 3,664,164 | 5/1972 | Zaidener | 70/202 |
| 3,752,518 | 8/1973 | Cannell | 292/259 X |
| 3,797,005 | 3/1974 | Schwarz | 70/94 X |
| 4,107,958 | 8/1978 | Manley, Jr. | 70/58 |
| 4,262,503 | 4/1981 | Kuebler | 292/259 R X |
| 4,318,559 | 3/1982 | Burton | 292/263 |
| 4,413,851 | 11/1983 | Ritter | 292/259 R |
| 4,461,385 | 7/1984 | Clouser | 70/58 X |
| 4,666,106 | 5/1987 | Kohout | 70/94 X |
| 4,669,767 | 6/1987 | Leto | 70/94 X |
| 4,788,840 | 12/1988 | Wilson, Jr. | 70/230 X |
| 4,819,461 | 4/1989 | Pearson | 70/14 |
| 4,971,374 | 11/1990 | Lovell et al. | 292/339 |
| 5,010,747 | 4/1991 | Norden, Jr. | 70/94 |
| 5,022,697 | 6/1991 | Hettwer | 70/238 X |
| 5,121,617 | 6/1992 | Chen | 70/209 |
| 5,299,721 | 4/1994 | Cummings | 70/58 X |
| 5,340,172 | 8/1994 | Sweet | 292/259 R |
| 5,419,165 | 5/1995 | Perkins | 70/14 |
| 5,439,210 | 8/1995 | Davis | 70/57 X |
| 5,466,023 | 11/1995 | Williamson | 292/259 R |

FOREIGN PATENT DOCUMENTS

| | | | |
|---|---|---|---|
| 153179 | 6/1990 | Japan | 70/94 |

*Primary Examiner*—Suzanne Dino Barrett
*Attorney, Agent, or Firm*—Summers, Compton, Wells & Hamburg, P.C.

[57] ABSTRACT

A locking device for protecting the contents of a container from theft includes an extension member having an adjustable length and a lock for inhibiting adjustment of the extension member's length when the lock is engaged. To secure the contents of a container from theft, the locking device is installed between two opposing surfaces, such as between two vertical wall surfaces, with the extension member extending across the container door with the door in its closed position. The locking device is installed by simply inserting each end of the extension member into suitable cavities formed in the opposing surfaces, or in brackets attached to the opposing surfaces, adjusting the length of the extension member as necessary. Thereafter, the lock can be engaged to prevent adjustment of the extension member's length, and thereby prevent removal of the ends of the extension member from the surface openings. With the locking device so installed, and the extension member extending across and perhaps contacting a portion of the container door, the container door cannot be opened by prying or otherwise without first removing the locking device. Because the locking device cannot be removed without adjusting the length of the extension member, which in turn requires possession of the correct key or combination to disengage the lock, unauthorized access to the container contents is prevented.

18 Claims, 2 Drawing Sheets

METHOD AND APPARATUS FOR LOCKING A STORAGE CONTAINER

BACKGROUND OF THE INVENTION (1) Field of the Invention

The present invention relates to a method and apparatus for locking a door and, more specifically, to a locking device for use with a container door or hatch to secure the contents of the container from theft.

(2) Description of the Related Art

There are a wide variety of storage containers and lockers in use today which comprise one or more compartments for storing tools, equipment, personal items, etc. A door is usually provided for the storage container to protect the contents of the container from the elements, for example, where the container is located outdoors, and the door may additionally be provided with a lock to protect the contents from theft. Examples of such storage containers are the deck lockers commonly found in the hull of a boat. These deck lockers include a door or hatch on the top surface of the locker which can be swung open or removed to provide access to the locker contents. Other examples of storage containers include storage cabinets, chests, closets, and so on which are commonly provided in tool sheds, buildings, boats, truck beds, etc. for storing and protecting various articles.

Where a storage container does not include a lock, the contents of the container are always susceptible to theft. However, even where the container is provided with a lock, it is often too easy to pry open the container door with a suitable leveraging device, thereby defeating the lock and providing access to the container's contents. This problem is particularly acute for storage containers that are located outdoors such that the container lock is the first and only line of defense to theft. As a result, even items stored in a lockable container can be exposed to a significant risk of theft, and due to this risk, individuals are sometimes reluctant to use such containers for their intended purpose.

What is needed is a locking device and method for quickly and easily protecting the contents of a container from theft by preventing unwanted opening of the container door. Such a device should be readily adaptable to the wide variety of container doors presently in use by the general public, including both hinged and unhinged doors (i.e., removable hatches). The locking device should have sufficient strength to withstand any attempt by a potential thief to defeat the device, and should be able to withstand any effort to pry open the container door, even where the door is not provided with a separate lock. The locking device should also be easily manufactured from inexpensive parts so as to minimize its cost.

SUMMARY OF THE INVENTION

The inventor hereof has succeeded at solving these and other needs in the art by designing and developing an elegantly simple locking device that can be easily installed adjacent to or across the door of a container or building to prevent unauthorized access to the contents thereof. The locking device can be quickly installed and removed with minimum effort, and can prevent a container door, for example, from being pried open, even where the container door is not provided with a separate lock. The locking device is also provided with an adjustable length so that it is readily adaptable to a wide variety of applications, and can also be customized for a particular application as necessary.

The inventor's preferred locking device comprises an extension member having an adjustable length, and a lock for inhibiting adjustment of the extension member's length when the lock is engaged. To secure the contents of a container from theft, the locking device is installed between two opposing surfaces, such as between two vertical wall surfaces, with the extension member extending across the container door with the door in its closed position. In its simplest embodiment, the locking device is installed by simply inserting each end of the extension member into suitable openings formed in the opposing surfaces, adjusting the length of the extension member as necessary. Thereafter, the lock can be engaged to prevent adjustment of the extension member's length, and thereby prevent removal of the ends of the extension member from the surface openings. With the locking device so installed, and the extension member extending across and perhaps contacting a portion of the container door, the container door cannot be opened by prying or otherwise without first removing the locking device. Because the locking device cannot be removed without adjusting the length of the extension member, which in turn requires possession of the correct key or combination to disengage the lock, unauthorized access to the container contents is prevented.

In other embodiments of the present invention, brackets are provided to interlock with the opposite ends of the extension member after the brackets are suitably attached to support surfaces. The preferred brackets have cavities formed therein, where the depths of the cavities limit the insertion distance of the extension member's ends. Alternatively, the brackets may comprise protuberances for insertion into the hollow ends of the extension member. In all of the preferred embodiments, however, the requisite function of the structural supports, e.g., the brackets or the support surfaces themselves where no brackets are used, is to limit the amount by which the length of the extension member can be increased. Because the preferred extension member is comprised of two telescoping pipes, the brackets and/or support surfaces serve to prevent the length of the extension member from being increased to the point that the telescoping pipes can be completely separated from one another. Thus, the brackets or support surfaces prevent disengagement of the telescoping pipes, while the lock prevents the length of the extension member from being decreased to the point that the ends of the extension member can be removed from the openings in the brackets or support surfaces. As a result, the locking device of the present invention can only be removed by removing the lock that otherwise prevents the length of the extension member from being decreased.

While the principal advantages and features of the present invention have been described above, a more complete and thorough understanding of the invention may be attained by referring to the drawings and description of the preferred embodiments which follow.

DETAILED DESCRIPTION OF THE PREFERRED EMBODIMENTS

Figure 1:
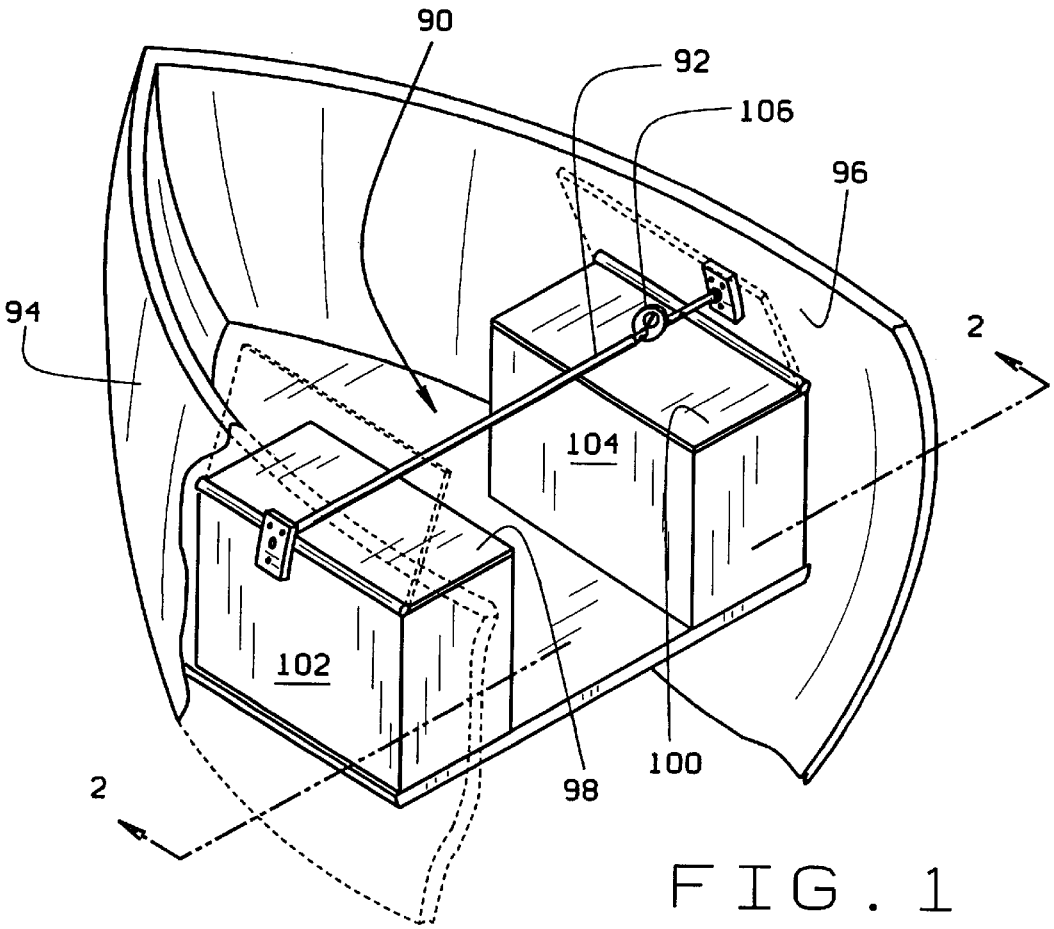
FIG. 1 is a partial isometric view illustrating a locking device according to the present invention installed in the hull of a boat.
Figure 2:
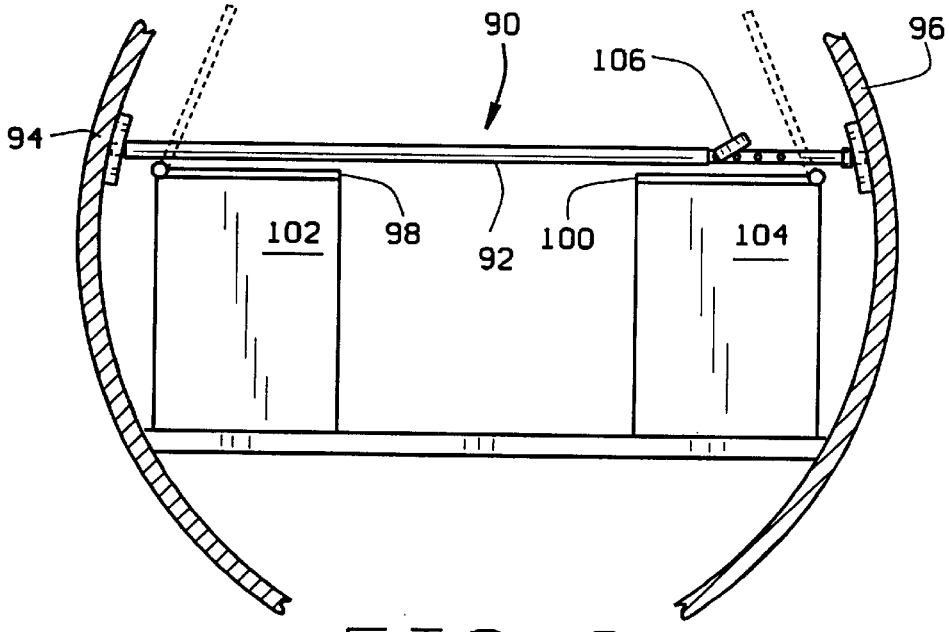
FIG. 2 is a cross-sectional view taken along line 2—2 in FIG. 1.

FIGS. 1 and 2 illustrate a preferred embodiment of a locking device in accordance with the present invention, which is designated generally by the reference character 90. The locking device 90 includes a substantially straight rod 92 attached to the left and right gunwales 94, 96 of a boat with the rod 92 extending immediately above the doors 98, 100 of two storage lockers 102, 104. With the locking device 90 so installed, movement of the doors 98, 100 to their open positions (shown in phantom) is prevented. Due to the durable construction of the locking device 90, as explained further below, the locking device can only be removed by one possessing the key or combination to a padlock 106. In this manner, the locking device of the present invention can prevent unauthorized access to the contents of the storage lockers. Although the locking device of the present invention is representatively shown and described with reference to boat storage lockers, it should be understood that the utility of the locking device is not so limited. On the contrary, the locking device of the present invention can be used for locking the door of virtually any type of container or building to thereby secure the contents thereof from theft. Depending upon the door to be secured, the locking device can also be installed in a vertical or diagonal orientation to prevent the opening or removal of, for example, a door provided on the front surface, rather than the top surface, of a container.

Figure 3:
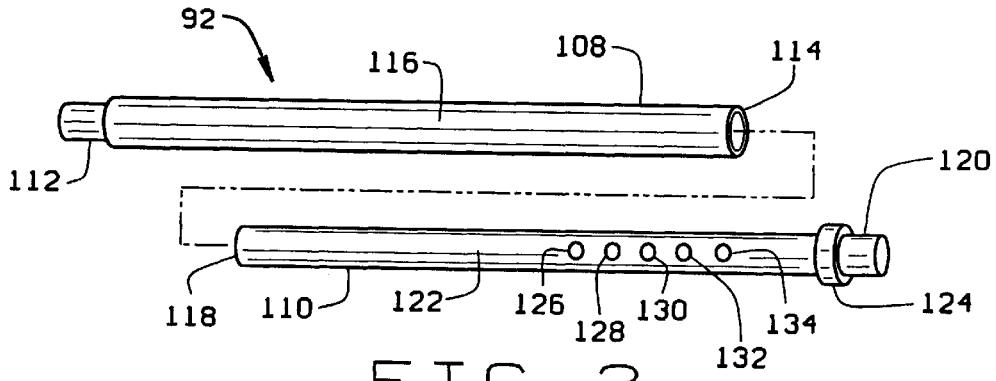
FIG. 3 is an exploded view illustrating the component parts of a telescoping rod according to a first embodiment of the invention.

In a first embodiment of the present invention, the rod 92 includes a receiving pipe 108 and a penetrating pipe 110, as shown in FIG. 3. The receiving pipe includes a first end 112, a second end 114, and a pipe body 116. Similarly, the penetrating pipe includes a first end 118, a second end 120, and a pipe body 122. The receiving pipe body 116 is hollow, and has a diameter slightly larger than the penetrating pipe body 122 so as to permit telescoping reception of the penetrating pipe within the receiving pipe. As a result, the pipes 108, 110 can be joined as indicated in FIG. 3 to yield the rod 92 having an adjustable length. While the pipes 108, 110 of the preferred embodiment are formed from tubular steel and have a circular cross section, the rod 92 can be formed from any type or number of structural members having, for example, a rectangular or other cross-sectional shape so long as the required strength, durability, and functionality of the locking device is achieved. The telescoping manner in which the length of the rod 92 can be adjusted is preferred, as it contributes significantly to the locking device's ease of use, but is not strictly necessary to practice the teachings of the present invention. The required wall thicknesses and lengths for the pipes 108, 110 depends upon the intended applications for the locking device and the various forces the device must withstand, as appreciated by those skilled in the art.

The first end 112 of the receiving pipe 108 is machined or otherwise necked-down as shown in FIG. 3 such that the diameter of the first end 112 is smaller than the diameter of the pipe body 116, including the portion of the pipe body adjacent to the first end 112. As a result, the first end 112 can be inserted into an opening having a slightly larger diameter, while the receiving pipe body 116 cannot be so inserted. For a similar purpose, the penetrating pipe 110 includes a collar 124 positioned adjacent to its second end 120, and having a diameter greater than the second end 120. The second end 120 can also be inserted into an opening having a slightly larger diameter, while the collar and thus the remaining portions of the penetrating pipe 110 cannot due to the diameter of the collar 124. The diameters of the first and second ends 112, 120 are preferably the same to permit insertion of the first end 112 and the second end 120 into openings having the same size.

As shown in FIG. 3, the penetrating pipe body 122 has several apertures 126, 128, 130, 132, 134 extending therethrough. Each of the apertures 126–134 are sized to receive the bolt or pin of the padlock 106. With the padlock engaging one of the apertures, the minimum length of the rod 92 will be fixed. In other words, the padlock 106 will prevent the aperture it engages from telescoping into the receiving element and, in this manner, will limit the degree to which the overall length of the rod 92 can be decreased. The apertures 126–134 are preferably positioned adjacent to the collar 124 so that a substantial portion of the penetrating pipe 110 can extend into the receiving pipe 108 when the device is in use, thereby contributing to the rod's strength and rigidity, and thus its ability to resist bending forces. For even greater strength, the penetrating pipe 110 can be a solid rod, rather than a hollow pipe.

Figure 4:
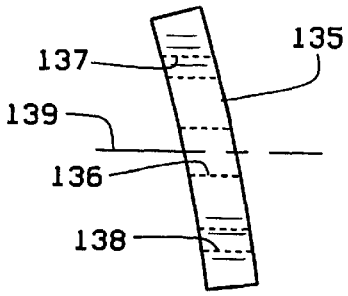
FIG. 4 is a side elevation view illustrating a bracket for the locking device of the first embodiment.

A bracket 135 configured for engagement with the first end 112 or the second end 120 of the adjustable rod 92 is shown in FIG. 4. The bracket 135 includes a center opening 136 extending therethrough, as well as several fastener openings 137, 138 which permit attachment of the bracket 135 to a suitable structure. In this first embodiment, the diameter of the center opening 136 is only incrementally larger than the diameter of the adjustable rod's first and second ends 112, 120 so that either end can be snugly received within the center opening 136. Because the first and second ends 112, 120 of the rod 92 have the same diameter, the bracket 135 can be considered a universal bracket, as it can be employed for interlocking with either one of the rod ends. Alternatively, where the first and second ends of the rod have differing diameters, a universal bracket can still be employed by sizing the diameter of the center opening to permit insertion of the larger of the first and second ends, provided the diameter of the center opening is not so great as to allow removal of the smaller of the two ends without first decreasing the rod's length. Note also that the bracket 135 of this preferred embodiment is slightly curved, and the center axis 139 of the center opening 136 is not tangential to the bracket's curvature. This configuration allows the bracket to completely engage and be attached to a structural surface having a corresponding curvature, such as the gunwales of the boat shown in FIGS. 1 and 2, while at the same time allowing the center opening 136 to receive one end of the adjustable rod 92 with the rod extending in a substantially horizontal direction. Hence, in accordance with the present invention, the bracket can be shaped to mate with either a curved or non-curved structural surface while still allowing one end of the adjustable rod to be received within the bracket's center opening with the rod extending in a substantially horizontal (or vertical) direction, as may be desired for a given application. Regardless of whether the bracket 135 is curved and whether the center axis 139 of the opening 136 is tangential to the bracket's curvature, the size of the center opening can also be increased as necessary to permit reception of one of the rod ends with the rod extending in a horizontal or vertical direction, even where the surface to which the bracket is mounted is an inclined surface rather than a horizontal or vertical one.

Figure 5:
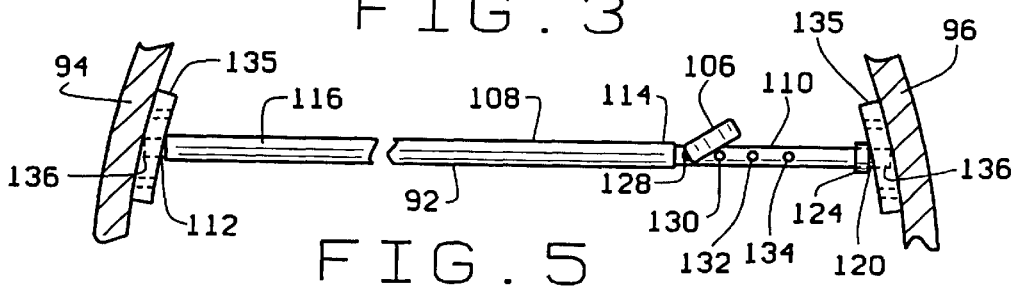
FIG. 5 is an enlarged view of a portion of FIG. 2 further illustrating the locking device of the first embodiment.

FIG. 5 illustrates the locking device 90 of the first embodiment installed in the environment shown generally in FIGS. 1 and 2. As can be seen, two identical brackets 135 are first attached to the left and right gunwales 94, 96 of a boat. Thereafter, the locking device 90 is positioned with the rod 92 extending generally horizontally between the center openings 136 of the brackets 135. The length of the adjustable rod 92 is then increased, by sliding the receiving pipe 108 and the penetrating pipe 110 in opposite directions, until the first and second ends 112, 120 of the rod 92 are inserted into the center openings 136 of the brackets 135. Thereafter, the padlock 106 is engaged with the aperture 128 closest to, but completely uncovered by, the receiving pipe 108. With the locking device so installed, the collar 124 of the penetrating pipe 110 and the pipe body 116 of the receiving pipe 108 contact the brackets 126 so as to prevent the length of the rod from being increased. Hence, the penetrating pipe cannot be disengaged from the receiving pipe as shown in FIG. 3 while the locking device is installed as shown in FIG. 5. Similarly, the engagement of the padlock 106 with the aperture 128 substantially inhibits one from decreasing the length of the rod 92. Though the length of the rod may be increased and decreased slightly due to the play caused by the distance between the aperture 128 and the second end 114 of the receiving pipe 108, the lengths of the rod's first and second ends 112, 120 are greater than the separation distance between each adjacent pair of apertures. Thus, to remove the locking device 90, the padlock 106 must be disengaged from the aperture 128 using the appropriate key or combination, and the length of the rod 92 must be sufficiently decreased as to permit removal of the rod's first and second ends 112, 120 from the center openings 136 of the brackets 135. In this manner, the locking device of the present invention can be used to protect the contents of one or more storage lockers, even where the storage lockers are positioned outdoors such that the locking device serves as the first and perhaps only line of defense to theft.

Where the locker doors include separate locks, the locking device 90 is preferably installed with the rod 92 in direct contact with the doors 98, 100 in their closed positions. This enables the locking device 90 to share the forces that will be exerted on the separate locks if one attempts to pry the doors open, and thereby protects the locks from damage. The locking device can also be installed, where desirable, with one end of the rod attached directly to the container door and the other end attached to a support surface. In addition, it should also be understood that while brackets are shown and described in the preferred embodiments, these brackets can be replaced by suitable openings in the support surfaces, such as the left and right gunwales of a boat, provided that the support surfaces have a strength sufficient to prevent puncture or tear-out as a result of forces which might be applied to the locking device by a potential thief.

Figure 7:
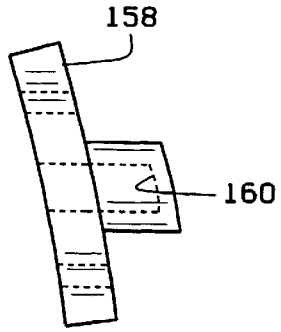
FIG. 7 is a side elevation view illustrating a bracket for the locking device of the second embodiment.
Figure 6:
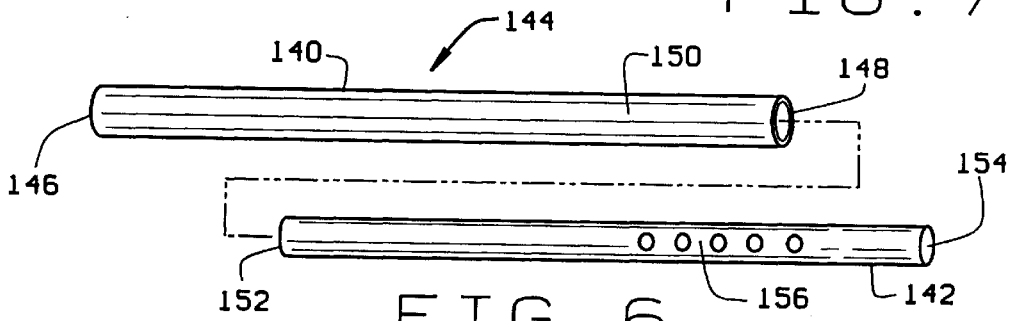
FIG. 6 is an exploded view illustrating the component parts of a telescoping rod according to a second embodiment of the invention.

FIG. 6 illustrates a receiving pipe 140 and a penetrating pipe 142 used to form a telescoping rod 144 according to a second embodiment of the present invention. The receiving pipe 140 includes a first end 146, a second end 148, and a pipe body 150, and the penetrating pipe 142 includes a first end 152, a second end 154, and a pipe body 156. The receiving pipe 140 does not include a necked-down portion, and the penetrating pipe does not include a collar. Instead, a bracket 158 can be used which has a closed cavity 160 formed therein, as shown in FIG. 7. The manner in which the locking device functions in this second embodiment is substantially the same as the first, but it is the cavity 160 of the bracket 158 that limits the extent to which the telescoping rod's first and second ends 146, 154 can be inserted therein, and thus the degree to which the length of the telescoping rod 144 can be increased. Because the diameter of the receiving pipe 140 is necessarily greater than the diameter of the penetrating pipe 142 to permit telescoping reception thereof, the telescoping rod's first end 146 has a larger diameter than the second end 154. Therefore, the bracket cavity 160 must be sized to accommodate the telescoping rod's first end 146 if the bracket 158 is intended to be universal, i.e., usable for interlocking with either of the telescoping rod's first and second ends 146, 154. Alternatively, the first end 146 of the receiving pipe 140 can be necked-down, as in the first embodiment, so that the first end 146 and the second end 154 have the same diameter.

Figure 8:
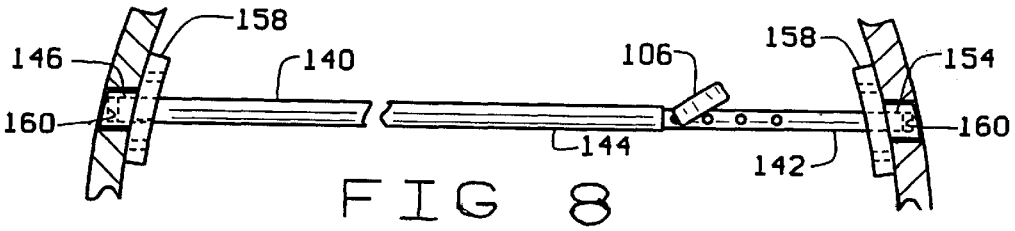
FIG. 8 is a view similar to FIG. 5 but illustrating the locking device of the second embodiment.

The locking device according to this second embodiment is shown in use in FIG. 8. As before, the padlock 106 prevents the length of the telescoping rod 144 from being sufficiently decreased as to permit removal of its first and second ends 146, 154 from the bracket cavities 160. In this embodiment, however, it is the bracket cavities 160 that prevent the telescoping rod 144 from being lengthened to the point that the penetrating pipe 142 can be completely removed from the receiving pipe 140. Instead, the locking device can only be removed by disengaging the padlock 106, and then decreasing the rod's length as necessary to permit removal of the first and second ends 146, 154 from the bracket cavities 160.

There are various changes and modifications which may be made to the invention as would be apparent to those skilled in the art. However, these changes or modifications are included in the teaching of the disclosure, and it is intended that the invention be limited only by the scope of the claims appended hereto, and their equivalents.

What is claimed is:

1. A locking device comprising a rigid extension member having an adjustable length and opposite first and second end portions, a lock for selectively inhibiting adjustment of the extension member's length, a first bracket having a closed cavity formed therein for receiving the first end portion, and a second bracket having a closed cavity formed therein for receiving the second end portion, the first bracket and the second bracket each having a curvature complimentary to a curvature of a support surface to which the bracket will be mounted, said first and second cavities being oriented to permit reception of the extension member's end portions when the extension member is extending in a substantially horizontal direction, wherein the first and second end portions cannot be disengaged from the first and second bracket cavities when the first and second brackets are each secured to a support surface without decreasing the length of the extension member.

2. The locking device of claim 1 wherein the size and shape of the first end portion is substantially identical to the size and shape of the second end portion.

3. The locking device of claim 2 wherein the first and second brackets are substantially identical.

4. The locking device of claim 2 wherein at least one of said end portions comprises a necked-down portion of the extension member.

5. The locking device of claim 1 wherein the closed cavities of the first and second brackets prevent the extension member's end portions from extending therein more than a predetermined distance.

6. A locking device comprising a rigid extension member having an adjustable length and opposite first and second hollow end portions, a lock for selectively inhibiting adjustment of the extension member's length, a first bracket having a protuberance extending therefrom for engaging the first hollow end portion, and a second bracket having a protuberance extending therefrom for engaging the second hollow end portion, wherein the first and second hollow end portions cannot be disengaged from the first and second bracket protuberances when the first and second brackets are each secured to a support surface without decreasing the length of the extension member.

7. The locking device of claim 6 wherein the size and shape of the first end portion is substantially identical to the size and shape of the second end portion.

8. The locking device of claim 7 wherein the first and second brackets are substantially identical.

9. The locking device of claim 7 wherein at least one of said end portions comprises a necked-down portion of the extension member.

10. The locking device of claim 6 wherein the first bracket and the second bracket each have a curvature complimentary to a curvature of a structure to which the bracket will be mounted, and said first and second protuberances are oriented to permit engagement with the extension member's end portions when the extension member is extending in a substantially horizontal direction.

11. A method for securing the contents of a boat storage locker from theft using a locking device that includes an extension member having an adjustable length, a first bracket, a second bracket, and a lock, the method comprising the steps of:

attaching the first bracket and the second bracket to a first surface and a second surface, respectively, within the boat;

positioning the locking device with the extension member adjacent to a door of the storage locker with the door in a closed position such that opening of the door without moving the extension member is at least substantially inhibited;

interlocking a first end of the extension member with the first bracket;

interlocking a second end of the extension member with the second bracket while maintaining the interlocking of the extension member's first end with the first bracket, adjusting the length of the extension member as may be necessary; and engaging the lock to inhibit adjustment of the extension member's length and to prevent disengagement of either of the extension member's first and second ends from the first and second brackets, respectively, thereby securing the contents of the boat storage locker from theft.

12. The method of claim 11 wherein the first and second surfaces are the left and right gunwales of the boat and the attaching step includes attaching the first and second brackets to the left and right gunwales, respectively.

13. The method of claim 11 wherein the positioning step includes positioning the locking device with the extension member in contact with the door.

14. The method of claim 11 wherein the positioning step includes positioning the locking device with the extension member extending adjacent to a plurality of doors in their closed positions.

15. The method of claim 11 wherein each bracket has an opening extending therethrough for receiving one of the extension member's ends and the interlocking steps include interlocking the extension member's ends with said bracket openings.

16. The method of claim 11 wherein each bracket has a closed cavity formed therein for receiving one of the extension member's ends and the interlocking steps include interlocking the extension member's ends with said bracket cavities.

17. The method of claim 11 wherein the extension member's ends are hollow, each bracket has a protuberance extending therefrom for mating with one of the extension member's hollow ends, and the interlocking steps include interlocking the extension member's hollow ends with said bracket protuberances.

18. The method of claim 11 wherein one of the support surfaces comprises the door of the boat storage locker.

* * * * *